United States Patent [19]

Neubert

[11] Patent Number: 4,876,715

[45] Date of Patent: Oct. 24, 1989

[54] SANITIZING DEVICE FOR A TELEPHONE

[76] Inventor: Donald F. Neubert, W225 N4007 Grandview Dr., Pewaukee, Wis. 53072

[21] Appl. No.: 263,013

[22] Filed: Oct. 26, 1988

[51] Int. Cl.[4] ..... H04R 1/12

[52] U.S. Cl. ..... 379/452; 379/439; 379/447

[58] Field of Search ..... 379/452, 437, 439, 451, 379/447, 450

[56] References Cited

U.S. PATENT DOCUMENTS

| | | | |
|---|---|---|---|
| 872,204 | 11/1907 | Shrader | 379/452 |
| 984,558 | 2/1911 | Graham | 379/452 |
| 1,147,312 | 7/1915 | Daniel | 379/452 |
| 1,472,530 | 10/1923 | McComas | 379/452 |
| 1,493,557 | 5/1924 | Meadoff | 379/452 |
| 2,763,735 | 9/1956 | Wahl | 379/452 |

FOREIGN PATENT DOCUMENTS

| | | | |
|---|---|---|---|
| 3321760 | 12/1974 | Fed. Rep. of Germany | 379/452 |
| 2649297 | 5/1978 | Fed. Rep. of Germany | 379/439 |
| 324468 | 4/1936 | Italy | 379/452 |

*Primary Examiner*—Jin F. Ng

*Assistant Examiner*—Danita R. Byrd

*Attorney, Agent, or Firm*—Andrus, Sceales, Starke & Sawall

[57] ABSTRACT

A sanitizing device for a telephone. A housing is mounted alongside the telephone and includes two pair of openings, each pair spaced to receive the mouthpiece and earpiece of the telephone. Located within each opening of the first pair is a nested stack of sanitized cup-like filters and the inner surface of the periphery of each filter bears a strip of pressure sensitized adhesive. By inserting the mouthpiece and earpiece within the respective openings, a filter will adhere to both the mouthpiece and earpiece. To remove the filters after use of the telephone, the mouthpiece and earpiece are inserted within the openings of the second pair and spiral rubber-like flaps which are disposed across each opening act to remove the filters as the receiver is withdrawn. In a second form of the invention, the sanitizing device takes the form of a rigid adapter including a perforated mouth section and a perforated ear section which is snap fitted over the receiver of the telephone. After use, the adapter is stored in a box containing a sanitizing agent.

11 Claims, 2 Drawing Sheets

SANITIZING DEVICE FOR A TELEPHONE

BACKGROUND OF THE INVENTION

It is recognized that bacteria and viruses can be transmitted through use of a telephone receiver and the transmission is particularly evident with respect to public telephones. Various attempts have been made in the past to sanitize a telephone but none have met with commercial success. For example, it has been proposed to mount a roll of sanitized paper adjacent the mouthpiece of a pay telephone and roll out a section of the paper over the mouthpiece when the telephone is in use.

It is also been proposed in the past to attach a sanitized shield of paper or fabric to the mouthpiece of the receiver, or to subject the receiver to ultraviolet light to sanitize the mouthpiece and earpiece. However, these proposals have been difficult to implement, or require a modification of the existing telephone, or require a source of electrical energy not available at public pay telephones.

SUMMARY OF THE INVENTION

The invention is directed to a sanitizing device for a telephone. In accordance with the invention, the sanitizing invention includes a housing that is mounted alongside the telephone and includes two pair of openings, each pair being spaced to receive the mouthpiece and earpiece, respectively, of the telephone receiver.

Located in each opening of the first pair is a nested stack of sanitized cup-like filters made of fibrous material, such as paper. The inner surface of the periphery of each filter contains a strip or band of a pressure sensitive adhesive. As the mouthpiece and earpiece are inserted within the openings, a filter will adhere to both the mouthpiece and earpiece.

Located in each opening of the second pair is a filter removal mechanism which preferably takes the form of a series of spiral overlapping flexible flaps made of rubber-like material. When the mouthpiece and the earpiece are inserted within the openings and withdrawn, the rubber-like flaps will engage and remove the filters from the receiver.

The invention provides an effective sanitizing device for a telephone that can be installed with either private or public telephones and without alteration of the telephone itself. Further, the sanitizing device does not require electrical energy so that it can be used in public pay telephone booths.

In a second form of the invention, the sanitizing device takes the form of a rigid adapter, preferably formed of a plastic material, and including a perforated mouth section and a perforated ear section which are connected by a central connecting section. The adapter is normally contained by the user in a box or casing containing a sanitizing agent. When using the telephone, the adapter is removed from the box and snap fitted over the receiver. This embodiment of the invention is intended for individual use and can be readily carried in a handbag or automobile to provide complete sanitization of a public telephone.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
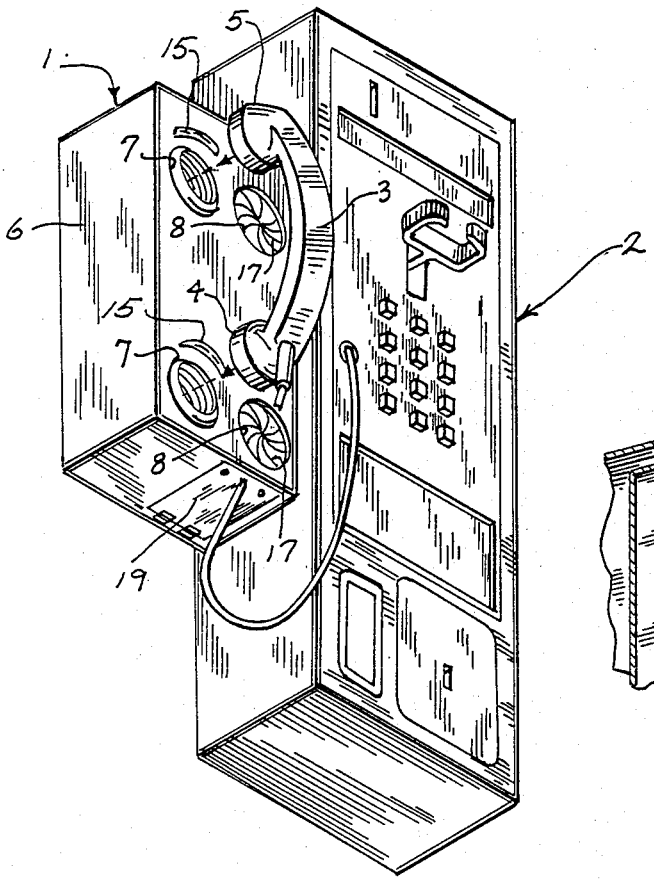
FIG. 1 is a perspective view of the sanitizing device of the invention as mounted alongside a public telephone.
Figure 3:
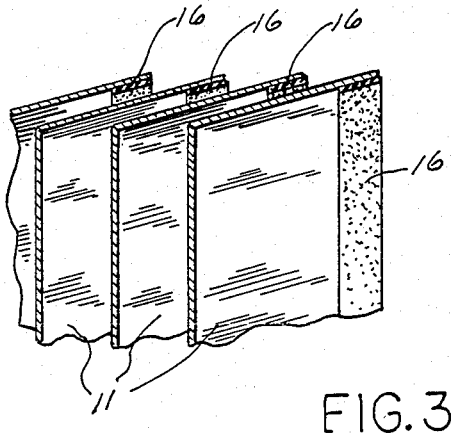
FIG. 3 is a fragmentary partially exploded section showing the nested filter cups.
Figure 2:
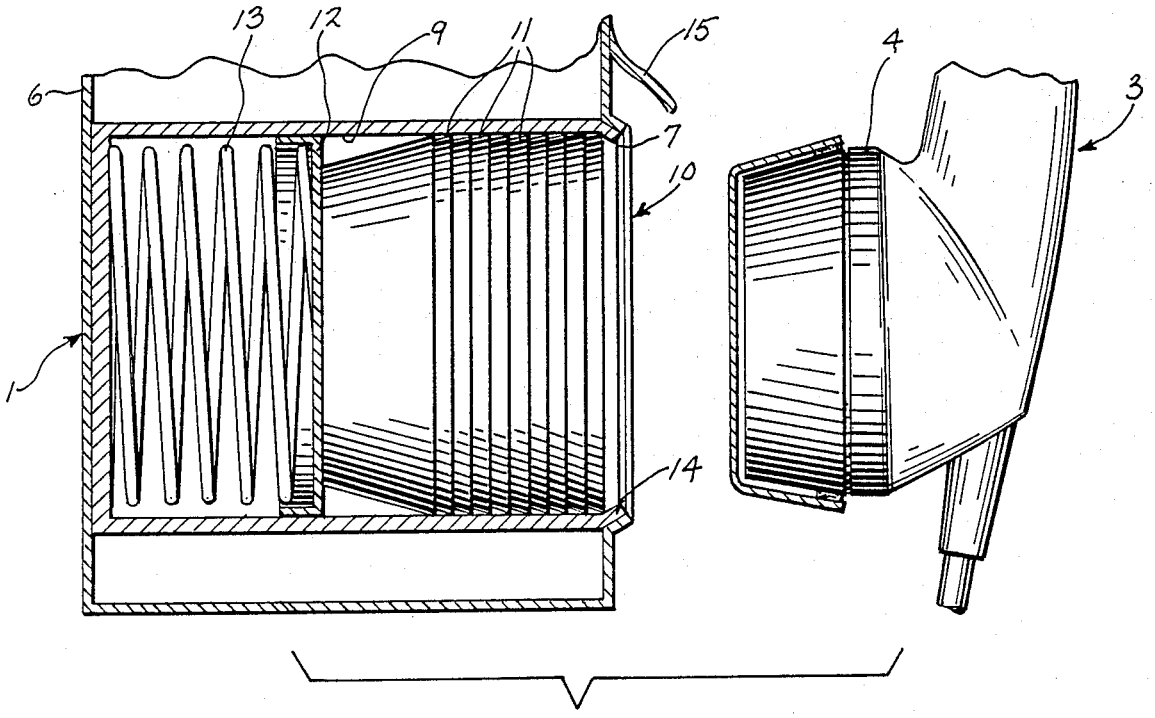
FIG. 2 is a fragmentary vertical section showing the mounting, of the nested filter cups in the housing.

FIGS. 1–3 illustrate a sanitizing device 1 that can be associated with a telephone 2. The sanitizing device has particular use in association with a public pay telephone or a public telephone as may be used in a hotel, office, restaurant or the like.

Telephone 2 is a standard type and includes a receiver 3 having a mouthpiece 4 and an earpiece 5.

The sanitizing device 1 includes an outer, generally boxed shaped housing 6 having a pair of spaced openings 7 as well as a pair of spaced openings 8. The spacing between the openings 7, as well as the spacing between the openings 8, is such that the mouthpiece and earpiece 4, 5 of the receiver can be inserted within the respective openings.

As shown in FIG. 2, each opening 7 communicates with a generally cylindrical compartment 9 formed in housing 6, and a nested stack 10 of sanitized filters 11 are contained within the compartment 9. Each filter 11 is formed of a porous, fibrous material, such as paper or plastic and is designed with a density so that it will not impede sound. Filters 11 are preferably impregnated with a sanitizing agent or bacteriacide.

Stack 10 of filters 11 is biased forwardly toward opening 7 by a pressure plate 12 which is mounted for sliding movement within compartment 9. A spring 13 is interposed between pressure plate 12 and the back wall of the housing 6 and serves to urge the stack 10 forwardly within the housing.

Each opening 7 is bordered by a inwardly extending lip 14 which prevents the filters 11 from freely falling from the opening under the influence of spring 13.

To provide weather protection for the filters contained with the compartments 9, a generally curved shield 15 is located above each opening 7 and projects outwardly from the front surface of housing 6.

As best illustrated in FIG. 2, the inner surface of the peripheral rim of each filter 11 is provided with a band or strip 16 of a pressure sensitive adhesive. The back surface of the peripheral rim of each filter can be impregnated with a release agent so that the adhesive 16 on the adjacent filter will not adhere to the rim.

At the time of use, the user inserts the mouthpiece 4 and earpiece 5 into the respective openings 7, causing the outermost filters 11 to adhere to the mouthpiece and earpiece. The sanitized filters thus will provide a sanitized instrument. As previously noted, the filters are designed so that they will not appreciably reduce the transmission of sound.

Each of the openings 8 includes a removal mechanism 17 for removing the filters 11 from the mouthpiece and earpiece after use of the telephone. The removal mechanism 17 takes the form of a plurality of spiral, overlapping, flexible flaps formed of rubber or rubber-like material which enclose each of the openings 8. When the mouthpiece 4 and earpiece 5 are inserted within the openings 8 and then withdrawn, the rubber flaps will engage the filters to remove the filters from the receiver. The filters drop downwardly within the housing and the spent filters can be removed from the housing through a trap door 19 located in the bottom surface of the housing.

The construction as shown in FIGS. 1–3 provides an effective sanitizing device for a telephone and can be used with a private or public telephone without the necessity of altering or modifying the telephone.

Figure 4:
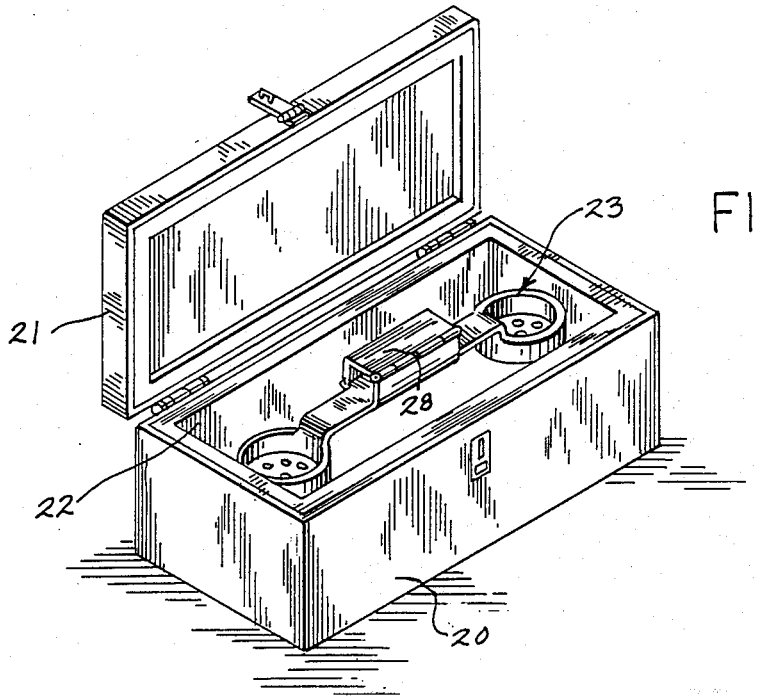
FIG. 4 is a perspective view of a modified form of a sanitizing device.
Figure 5:
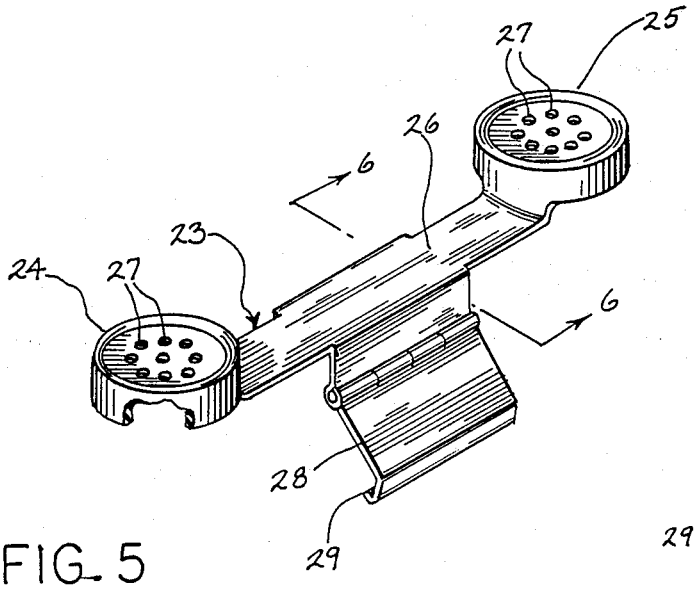
FIG. 5 is a perspective view of the adapter.
Figure 6:
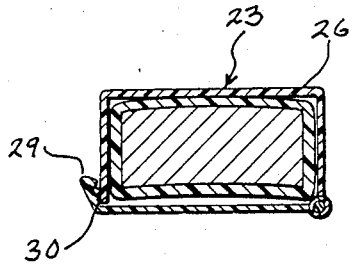
FIG. 6 is a transverse section taken along line 6—6 of FIG. 5.

A modified form of the sanitizing device is shown in FIGS. 4–6. As illustrated, a box or container 20 has a hinged cover 21 and the box is lined with a foam plastic lining 22 which is adapted to be impregnated with a sanitizing agent or bacteriacide.

A rigid adapter 23, preferably formed of a plastic material, is stored in the box 20 and the adapter 23 includes a mouthpiece section 24, an earpiece section 25 and a connecting section 26. The mouthpiece section and earpiece sections are provided with perforations or holes 27.

The adapter 23 is intended to be snap-fitted on a telephone with the mouthpiece section 24 covering the mouthpiece 4 of the telephone and the earpiece section 25 covering the earpiece 5.

To aid in attaching the adapter to the telephone, the adapter may include a hinged central section 28 and the outer extremity of the central section 28 is provided with a lip 29 which engages a ridge 30 on connecting section 26. By pivoting the central section 28 around the central portion of the telephone receiver and engaging the lip 29 with ridge 30, the adapter will be securely engaged with the telephone receiver.

The adapter 23 is normally stored in the box 20 in contact with the sanitizing agent contained within the foam lining 22. When it is desired to use the telephone, the adapter is removed and snap-fitted on the telephone. After use of the telephone, the adapter is removed and returned to its storage position in box 20.

The embodiment of FIGS. 4–6 provides an effective sanitizing device, particularly useful for public telephones. The device is adapted for individual usage and the box 20 containing the adapter 23 can be readily stored in a handbag or glove compartment of an automobile.

Various modes of carrying out the invention are contemplated as being within the scope of the following claims particularly pointing out and distinctly claiming the subject matter which is regarded as the invention.

I claim:

1. A sanitizing device for a telephone, comprising a housing having a pairs of first openings disposed to receive respectively the mouthpiece and earpiece of a telephone, a nested stack of generally cup-shaped filters disposed within each opening, and a layer of a pressure sensitive adhesive on the inner surface of each filter and disposed to engage the outer surface of the respective mouthpiece and earpiece as the mouthpiece and earpiece are inserted within the openings to thereby adhere the filters to the mouthpiece and earpiece.

2. The device of claim 1, wherein said housing is provided with a pair of second openings disposed respectively to receive the mouthpiece and earpiece of the telephone, and means associated with each of said second openings for removing said filters from the respective mouthpiece and earpiece as the mouthpiece and earpiece are inserted within said second openings.

3. The device of claim 1, wherein said means for removing said filters comprises a plurality of overlapping flexible flaps enclosing each second opening.

4. The device of claim 1, and including biasing means interconnecting the housing and each stack for urging each stack toward said opening.

5. The device of claim i, wherein each filter comprises a base and an outwardly extending annular flange, said layer of adhesive being disposed on the inner surface of said flange.

6. The device of claim 5, wherein each flange has a depth less than the depth of the respective mouthpiece and earpiece.

7. A sanitizing device for a telephone comprising a housing having a pair of first openings disposed to receive the mouthpiece and earpiece of a telephone respectively, a nested stack of sanitized generally cup shaped filters disposed within each of said first openings, an adhesive on the inner surface of each filter and disposed to engage the outer surface of the respective mouthpiece and earpiece as the mouthpiece and earpiece are inserted within said first openings to thereby adhere said filters to the respective mouthpiece and earpiece, said housing having a plurality of second openings disposed to receive the mouthpiece and earpiece respectively, and means associated with each of said second openings for removing the filters from the mouthpiece and earpiece as the mouthpiece and earpiece are inserted and withdrawn from said second openings.

8. The device of claim 7, and including a sanitizing agent impregnated in each of said filters.

9. The device of claim 7, and including access means in the lower portion of said housing to remove used filters removed by said removal means.

10. The device of claim 7, wherein each filter comprises a base and an outwardly extending annular flange, said adhesive being disposed as a thin band on the inner surface of said flange.

11. The device of claim 7, wherein said removal means comprises a plurality of overlapping rubber-like segments spaced circumferentially of each second opening and substantially enclosing each second opening.

* * * * *